United States Patent [19]

Dobrinski et al.

[11] Patent Number: 4,919,050

[45] Date of Patent: Apr. 24, 1990

[54] WELL PERFORATING DEVICE

[76] Inventors: John W. Dobrinski, Rt. 5 Box 125, Weatherford, Okla. 73096; Thomas L. Elliston, 1401 Westover La., Ft. Worth, Tex. 76107

[21] Appl. No.: 284,190

[22] Filed: Dec. 14, 1988

[51] Int. Cl.[5] ..... F42B 1/02

[52] U.S. Cl. ..... 102/307; 102/310; 102/313; 102/476; 102/493

[58] Field of Search ..... 102/306, 307, 310, 312, 102/313, 476, 492, 493

[56] References Cited

U.S. PATENT DOCUMENTS 3,913,488 10/1975 Duneta et al. ..... 102/92.1
3,970,005 7/1976 Rothman ..... 102/67
4,068,590 1/1978 Pearson ..... 102/67
4,643,097 2/1987 Chawla et al. ..... 102/306

*Primary Examiner*—Peter A. Nelson
*Attorney, Agent, or Firm*—Bill D. McCarthy

[57] ABSTRACT

An improved well perforating device comprising a body member in the form of a cylindrical pressure vessel containing shaped explosive charges positioned normal to the longitudinal axis of the body member. The perforating device body is systematically shaped externally at the foci of the hollow cones so that both focused and wall expansion energy of the explosive energy of detonation is sufficiently controlled to prevent excessive deformation of the outer diameter of the body member.

7 Claims, 2 Drawing Sheets

WELL PERFORATING DEVICE

BACKGROUND OF INVENTION

1. Field of the Invention.

The present invention relates generally to improvements in oil and gas well perforating devices, and more particularly, but not by way of limitation, to an improved perforating device which is able to function reliably under high hydrostatic pressures of very deep wells while remaining easily retrievable.

2. Discussion of the Prior Art.

Following the drilling of a typical oil or gas well, the well is completed by installing a well liner or casing, which is cemented into place, primarily to prevent the possibility of petroleum produces from entering and contaminating wafer bearing strata which may lie between the oil bearing strata and the surface. After this casing is in place, it is usually necessary to perforate the casing to enable fluids from the oil or gas bearing formations to flow into the well bore. The perforations are usually made by detonating a specially configured explosive charges which produce jets of extremely high pressure gases. Each high pressure jet blows a hole through the well casing and creates a fracture extending for some distance into the surrounding formation.

The explosive charge used for this purpose is commonly shaped into the form of a hollow cone to take advantage of the Munroe effect, which achieves remarkable penetration by focusing the explosive effect on one spot, much as a magnifying glass focuses the sun's rays. A single perforator device usually includes a plurality of explosive charges for making several casing perforations simultaneously.

Since the penetration ability of the perforator is highly dependent upon this hollow conical shape, it is necessary to protect the explosive charges, as well as the detonating cord, the detonators and the electrical wiring from the well bottom environment. The harshness of these environmental conditions is considerably exacerbated by the increasing depths to which current wells are drilled.

To provide adequate protection a pressure vessel (a perforating gun body) is usually provided to enclose the explosives, detonators, detonating cords and electrical wiring. The body of a retrievable perforating device, which serves as a pressure vessel, must have the following characteristics: (1) sufficient structural strength to resist the hydrostatic pressure in the well bore without collapsing since, as well depths increase, there is a corresponding increase in hydrostatic pressure; (2) sufficient structural strength to contain the effects of the explosions that occur when the perforating device is fired in order to protect the well casing from unnecessary damage; (3) confinement capability to contain the debris from the explosive charges to avoid contaminating the well; and (4) sufficient dimensional stability before and after detonation to allow the perforating device to be retrieved from the well bore.

As wells are drilled to ever deeper depths in the search for producible hydrocarbons, the tubular goods (casing, liner and tubing) have changed. To withstand the stresses caused by increased well pressures and higher tensile stresses due to longer strings of tubular goods, the trend is toward casing, pipe and tubing with thicker walls. Since the outside diameters of the tubular goods are held constant to conform to standard sizes, the increase in wall thickness means a reduction in inside diameter of the tubular goods.

Also, in the interest of maximizing well production rates, the trend has been toward larger perforating explosive charges to achieve higher performance perforations, i.e. larger hole sizes in conjunction with deeper penetrations. As expected, this requires dimensionally larger explosive charges with more explosive power, and this has lead to greater deformation of the perforating device about its circumference at the points of penetration. Retrieval of prior art perforating devices from deep wells following perforation by such larger explosive charges in close fitting tubular goods has often not been possible by the usual cable pulling technique because of the wall jamming between the perforating device and the surrounding tubular goods.

There has been a need for a perforating device that can deliver a larger more powerful explosive charge through tubular goods that have smaller internal diameters while avoiding the jamming interference between the perforated wall of the perforating device and the surrounding tubular goods.

SUMMARY OF INVENTION

The present invention provides a well perforating device having a plurality of explosive charges spaced at intervals along the longitudinal axis of the interior of the device and aligned perpendicularly to the longitudinal axis. The body of the perforating device is appropriately dimensioned to be slidingly received in the casing at the bottom of the well.

Each explosive charge is shaped substantially to have the form of a hollow cone, and is mounted within the interior of the body so that the axis of the cone is normal to the longitudinal axis of the perforating device body. The thickness of the wall of the perforating device body is reduced at the focus point of the explosive charge, and additionally, the wall thickness is reduced about the circumference of the perforating device body to form a recoil expansion zone which includes the point of focus of the shaped explosive charge. The amount of material removed in the recoil expansion zone is sufficient to permit controlled expansion of the perforating device body without increasing the outer diameter of the perforating device body.

An object of the present invention is to provide a well perforating device that has sufficient dimensional stability to permit the perforating device to be retrieved from the well bore following explosive penetration of the tubular goods.

Another object of the present invention, while achieving the above stated object, is to provide a well perforating device with sufficient structural strength to constrict the effects of the explosions to the desired direction and to protect the well casing from unnecessary damage.

An additional object of the present invention, while achieving the above stated objects, is to provide a well perforating device with sufficient structural strength such that debris from the explosive charges will not be scattered to contaminate the well.

Yet a further object of the present invention, while achieving the above stated objects, is to provide a well perforating device that can be safely and efficiently operated under the harsh environment encountered in deep petroleum wells.

Other objects, features and advantages of the present invention will be apparent from the following detailed description when read in conjunction with the drawings and appended claims.

DESCRIPTION

Figure 1:
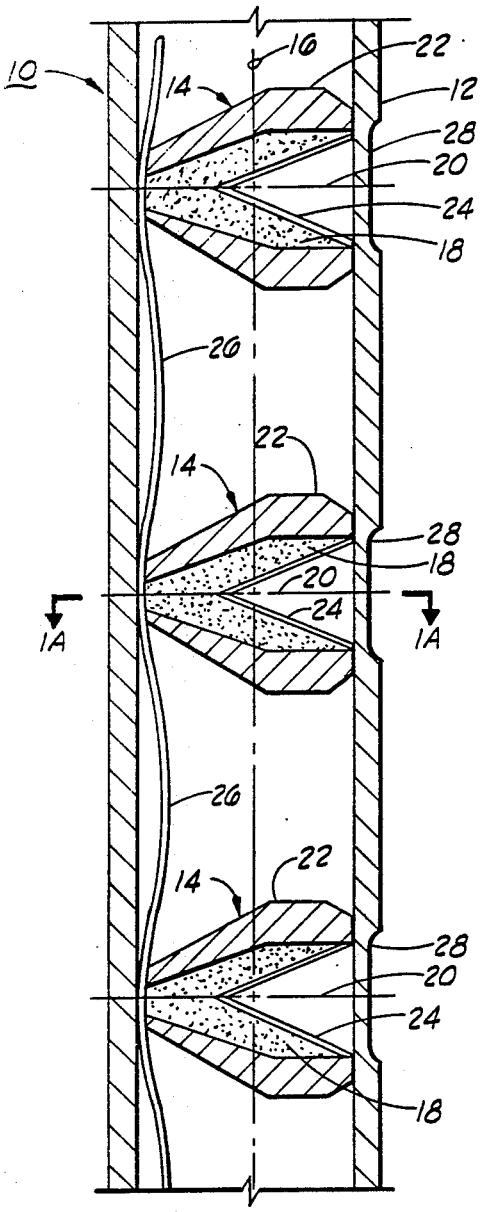
FIG. 1 is a partial, cross sectional view of a typical prior art well perforating device along the longitudinal axis of the device.

FIG. 1 is a semi-detailed, side elevational view in cross section of a prior art well perforating device 10 which is typical of perforating devices used to perforate strings and casings in a petroleum well. Usually, the perforating device 10 comprises a cylindrical body member 12 which serves as a pressure vessel to protect the perforating device 10 from the high hydrostatic pressures encountered in deep petroleum wells. The cylindrical body member 12, also sometimes referred to herein as the perforating device body, is shaped and suitably dimensioned to be slidably received within the longitudinal bore of a well casing or tubing (not shown).

In the interior bore of the body member 12 are a plurality of individual hole guns 14 which are spaced at intervals among the longitudinal axis 16 of the body member 12. Each individual hole gun 14 is comprised of a quantity of highly explosive material 18 shaped in the form of a hollow cone having an axis 20. In each of the hole guns 14 the explosive material 18 is contained within a gun breech block 22 and a thin metal, hollow cavity-forming cone 24. Each hole gun 14 is positioned within the bore of the body member 12 so that the base of the hollow cone 24 is substantially parallel with the longitudinal axis 16 of the body member 12. That is, the axes 20 of the cones 24 extend normally to the longitudinal axis 16.

A detonator cord 26 connects the hole guns 14 to a detonator (not shown) that is also contained within the body member 12. The detonator is connected via electrical wires (not shown) to suitable controls at the well head.

It will be noted that material is removed from the outside diameter of the body member 12 to form a body hole penetration area 28. That is, the cylindrical body member 12 of the perforating device 10 is systematically shaped by removal of material from its exterior surface to reduce the wall thickness of the body member 12 at the foci of the hollow cones 24. The hole penetration areas 28 are located on the outside surface of the cylindrical body member 12 immediately adjacent to the bases of the hollow cones 24, or that is, normal to the axes 20 of these cones. The wall thickness of the body member 12 at these hole penetration areas 28 is sufficient to withstand the hydrostatic pressures encountered at well depths, but when the hole guns 14 are detonated, the jets of expanding hot gases focused by the shape of the hollow cones 24 will readily penetrate the wall of the body member 12 at the body hole penetration areas 28, as well as that of the well casing or tubular member (not shown) and into the surrounding petroleum bearing strata (not shown). Usually, when the perforating device 10 is equipped with multiple individual hole guns 14, all of the guns 14 are detonated essentially simultaneously, creating a plurality of openings into the petroleum bearing strata.

Figure 2:
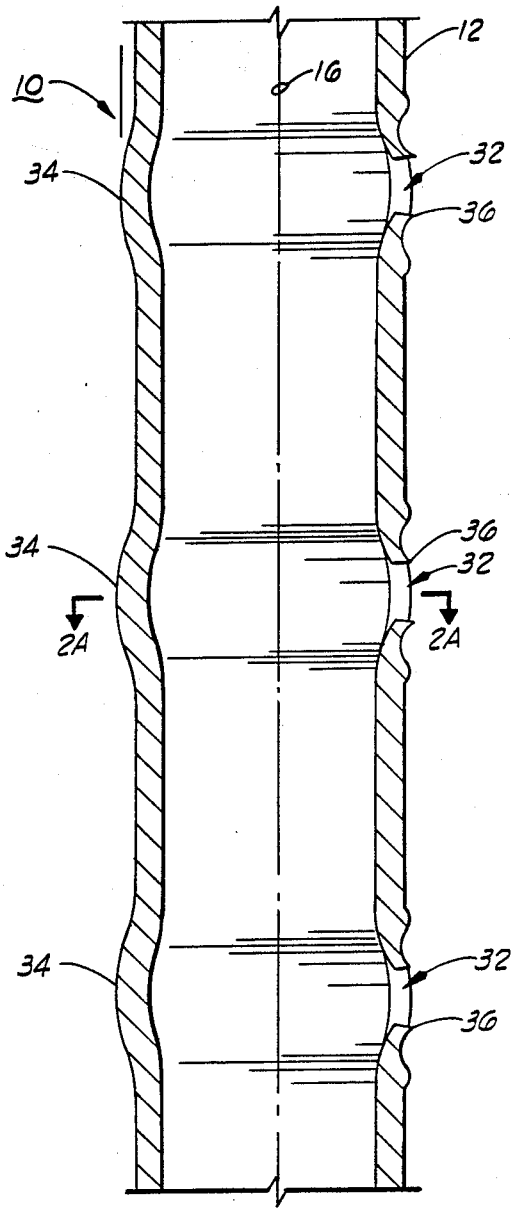
FIG. 2 is partial, cross sectional view of the prior art perforating device of FIG. 1 after detonation and taken along the longitudinal axis of the device.
Figure 1A:
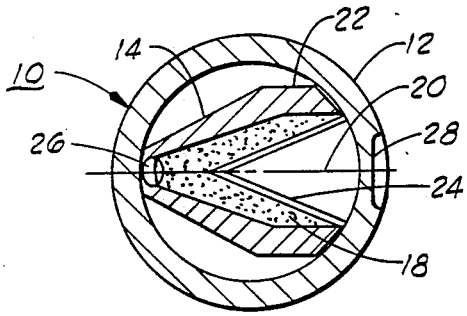
FIG 1A is a cross sectional view of the perforating device of FIG. 1 along line 1A—1A.
Figure 2A:
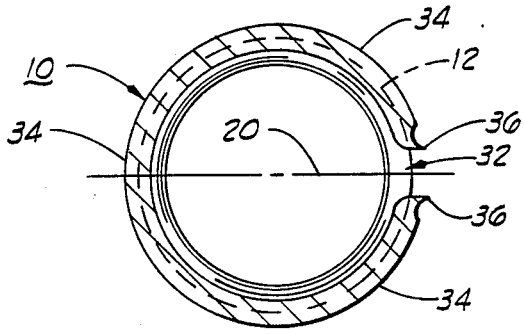
FIG. 2A is a cross sectional view of the perforating device of FIG. 2 taken along line 2A—2A.

FIG. 2 depicts the perforating device 10 after the detonation of the hole guns 14. Each of the hole guns 14 has been disintegrated by the explosive force of its explosive material 18 to form debris (not shown). As depicted in FIGS. 2 and 2A, the cylindrical body member 12 has been perforated in each of the body hole penetration areas 28 to form a series of penetration holes 32 thereat. The main force of each of the explosive shots of the hole guns 14 has thus been directed through the thin walled areas of the body hole penetration areas 28 to fracture the strata (not shown).

Further, while the shape of the hollow cones 24 of the hole guns 14 has directed the major explosive force toward the base of the hollow cones 24 thereof, a portion of the energy has swelled the body member 12 around its periphery, or circumference, in a blast energy absorbency zone 34 which protrudes on the external surface and around the body member 12. This recoil energy is dissipated by the deforming the body member 12 to form an externally extending ring as shown. Further, the force of the hot gas jets often causes the penetration holes 32 to have externally lipped burr areas 36 which extend beyond the normal dimension of the outer diameter of the cylindrical body member 12 as shown in FIGS. 2 and 2A.

The amount of expansion of the outer diameter of the cylindrical body member 12 of the perforating device 10 upon detonation of the hole guns 14 will be a function of the yield strength of the material used in the manufacture of the body member 12, and of the wall thickness in the blast energy absorbency zone 34. In deep well formations where the internal diameters of the tubular goods (the casing, tubing string or liner) is reduced due to the necessity of increased wall thicknesses of such members, and where hole guns having larger amounts of explosive material are used, the deformation of the external surface of the perforating device 10 can become critical. That is, it is often the case that this deformation increases the outer diameter of the body member to such a degree that jamming interference occurs with the internal diameter of the tubular goods surrounding the cylindrical body member 12. Since the perforating device 10 is usually lowered on a steel cable or the like, and removal is usually achieved by simple retrieval of the cable from the well casing, it will be appreciated that jamming of the perforating device 10 presents a major problem if it cannot be freed within the operating tensile force permitted on the supporting cable. In effect, a jammed perforating device 10 will require major extraction apparatus, such as a fishing tool, or drilling removal thereof.

Figure 3:
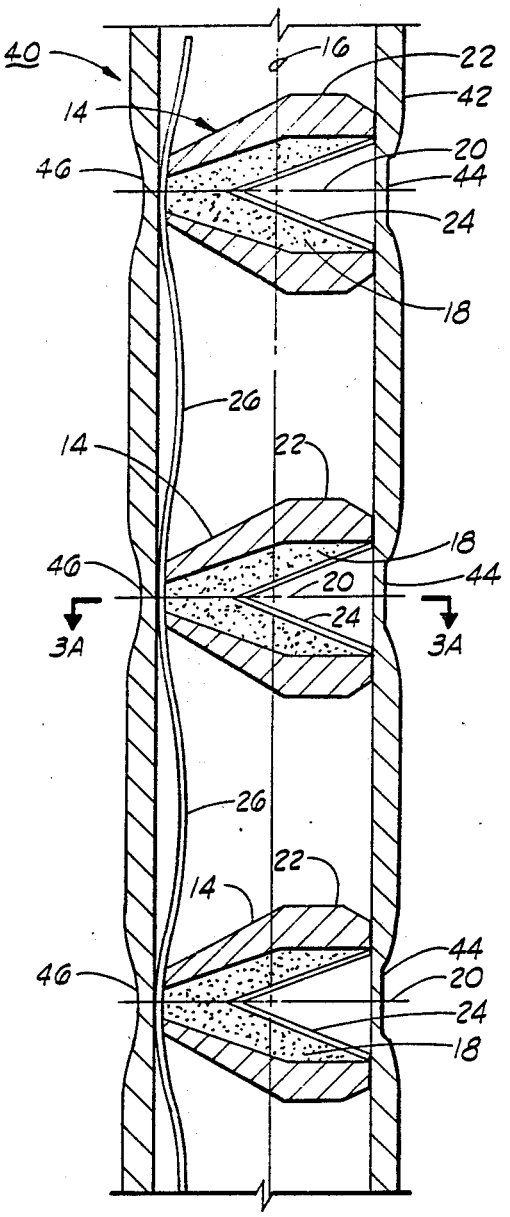
FIG. 3 is a partial, cross sectional view of a well perforating device constructed in accordance with the present invention and taken along the longitudinal axis of the perforating device.
Figure 3A:
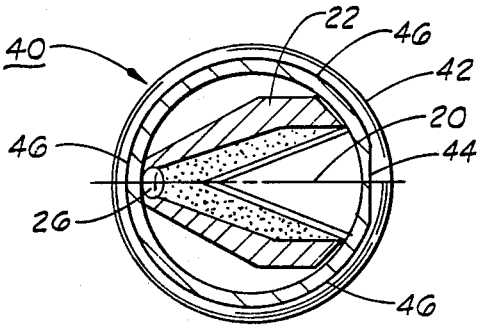
FIG. 3A is a cross sectional view of the perforating device shown in FIG. 3 taken along line 3A—3A.

Turning now to FIG. 3, shown therein is a well perforating device 40 which is constructed in accordance with the present invention and which is shown in partial, longitudinal cross sectional view, with a section of the perforating device 40 shown in FIG. 3A. The perforating device 40 comprises a cylindrical body member 42 which serves as a pressure vessel to protect the perforating device 40 from the high hydrostatic pressures encountered in deep petroleum wells. The cylindrical body member 42 is shaped and suitably dimensioned to be slidably receive within the longitudinal bore of a well casing or tubing (not shown).

In the interior bore of the body member 42 are a plurality of the individual hole guns 14 which are spaced at intervals along the longitudinal axis 16 of the body member 42. As described above, each individual hole gun 14 has a quantity of the explosive material 18 shaped in the form of a hollow cone about its axes 20. In each of the hole guns 14 the explosive material 18 is contained within its respective gun breech block 22 and thin metal, hollow cavity-forming cone 24. Each hole gun 14 is positioned within the bore of the body member 42 so that the base of each of the hollow cones 24 is substantially parallel to the longitudinal axis 16 of the body member 42. That is, the axes 20 of the cones 24 extend normally to longitudinal axis 16 of the body member 42.

A detonator cord 26 connects the hole guns 14 to a detonator (not shown) that is also contained within the body member 42. The detonator is connected via wires (not shown) to suitable controls at the well head.

As described above for the body member 12, material is removed from the outside diameter of the body member 42 to form a body hole penetration area 44. That is, the cylindrical body member 42 of the perforating device 40 is systematically shaped by removal of material from its exterior surface at the foci of the hollow cones 24. The hole penetration areas 44 are located on the outside surface of the cylindrical body member 42 immediately adjacent to the bases of the hollow cones 24 and normal to the axes 20 of these cones. The wall thickness of the body member 42 at these hole penetration areas 44 is sufficient to withstand the hydrostatic pressures encountered at well depths, but when the hole guns 14 are detonated, the jets of expanding hot gases will be focused by the shape of the hollow cones 24 to penetrate the wall of the body member 42 at the body hole penetration areas 44, as well as that of the wall casing or tubular string (not shown) and into the surrounding petroleum bearing strata (also not shown).

As noted above, the perforating device 40 is equipped with multiple individual hole guns 14, all of the guns 14 normally being detonated essentially simultaneously. As discussed above for the conventional perforating device 10, a portion of the energy from the detonation of the explosive material 18 of the hole guns 14 expands the outer diameter of the body member 10 at the blast energy absorption zones 34 shown in FIGS. 2 and 2A. This deformation of the external surface of the perforating device 10 at the blast energy absorbency areas 34, together with the burr areas 36 of the penetration holes 32, extend beyond the normal dimension of the outer diameter of the cylindrical body member 12.

It is well known that an explosion in a pressure vessel will tend to deform and expand it if the yield strength of the pressure vessel walls is exceeded. It was thought that an approach to solve the unwanted expansion of a well perforating device would be to construct its body member out of material with a high enough yield strength to prevent expansion. This is not workable because when the body member (which serves as a pressure vessel) is made from a higher yield strength material, the shock of the explosive charges of the hole guns tends to cause the body member to split open as opposed to forming directed shots as required to perforate a surrounding casing and strata.

This difficulty was solved by removing some of the outer wall of the body member 42 of the perforating device 40 in the vicinity of the explosive charge. That is, as shown in FIGS. 3 and 3A, material is removed from around the external surface of the body member 42 to form wall expansion zones 46 immediately adjacent to the hole guns 14 and normal to the axes 20 thereof, and to include the hole penetration areas 44. That is, the outer surface of the body member 42 is reduced in a tapered manner to reduce the wall thickness in each of the wall expansion zones 46 about the circumference, or periphery, of the body member. It will be noted that the thickness of the wall at the hole penetration areas 44 is less than the wall thickness at the wall expansion zones 46 since the hole penetration areas 44 will be perforated, while the wall expansion zones 46 will be expanded in a predictable manner. The purpose of this is that, after the hole guns 14 are detonated, the inevitable expansion will take place, but the outer diameter of the body member 42, following expansion caused by the explosions, will not be expanded beyond the normal outside diameter of the body member 42 of the perforating device 40.

Figure 4:
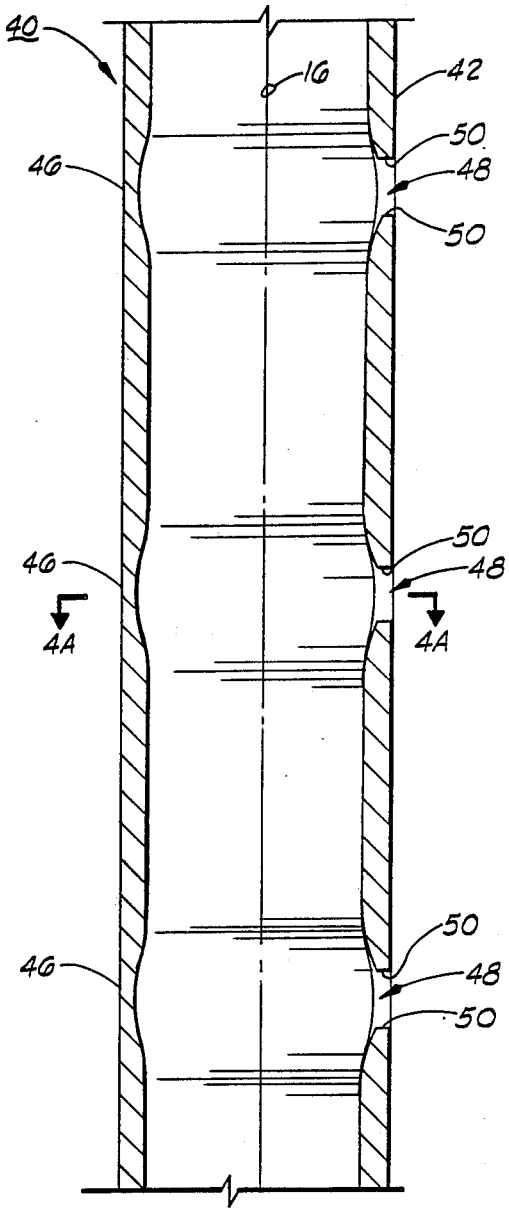
FIG. 4 is a partial, cross sectional view of the perforating device of FIG. 3 along the longitudinal axis thereof after detonation.
Figure 4A:
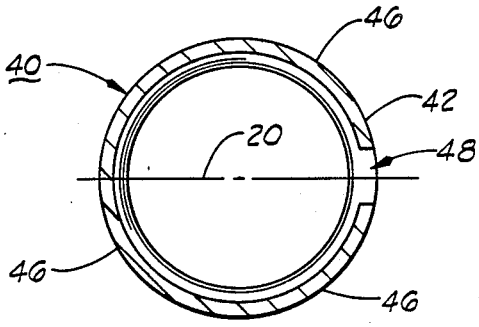
FIG. 4A is a cross sectional view of the perforating device of FIG. 3 along line 4A—4A.

This expansion is shown in FIGS. 4 and 4A which depict the body member 42 following detonation of the hole guns 14. Each of the hole guns 14 has disintegrated by the explosive force of the explosive material 18, forming debris which is not shown. The cylindrical body member 42 has been perforated in each of the body hole penetration areas 44 to form a series of penetration holes 48 thereat. The main force of each of the explosive shots of the hole guns 14 has thus been directed through the thin body hole penetration areas 44 to fracture the geological strata (not shown). Further, while the shape of the hollow cones 24 of the hole guns 14 has directed the major explosive force toward the base of the hollow cones, a portion of the energy has expanded the wall expansion zones 46 formed around the external surface of the body member 42 and which encompass the body hole penetration areas 44. This wall expansion energy has been dissipated through the deformation of the body member 42, but instead of forming externally extending rings as described above for the conventional penetrating device 10, the deformation has expanded the tapered wall expansion zones 46 such that the outer surface of the body member 42 appears smoothed and generally regular, and the expanded rings are avoided. Further, because a portion of the explosive energy has been adequately dealt with, the penetration holes 48 have externally lips 50 which do not protrude beyond the regular external surface of the body member 42.

It has been found that the characteristics of the pressure vessel material (that of the body member 42) are important with regard to the amount of yield strength thereof. That is, the material construction should have a moderately high yield strength along with high resistance to impact. The high yield strength provides sufficient structural strength for the pressure vessel to withstand the well's hydrostatic pressure, and the material's high impact resistance prevents unwanted splitting of the body member during detonation of the firing guns 14. The variation in wall thickness of the body member 42 achieves two results. First, the thicker wall areas of the body member 42 provides sufficient structural support to prevent collapsing of the body member 42 at high hydrostatic pressures. Secondly, these thicker wall areas of the body member 42 prevent the propagation of cracks that can occur around the periphery of the explosive charges of the hole guns 14 upon detonation.

EXAMPLE 1

In an experiment to demonstrate the present invention, a well perforating device was constructed in accordance with the description provided herein and having the following specifications. The cylindrical body member was constructed of steel tubing having a 1.625 inch internal diameter and a 2.000 inch outer diameter. The outer diameter was machined to reduce the outer diameter so that the outer diameter was 0.125 inch less at the perimeter of the tubing around each of the explosive charges. The yield strength of the steel was 180,000 psi, and it had an impact resistance of 45–55 ft-lbs (Izod). The explosive charge used was a 2 ⅛ inch D.P. charge, Part No. 5202–1210 manufactured by Shape Charge Specialists, Inc. of Mansfield, Texas, and had an explosive load of 6.5 grams of RDX. The perforating gun assembly was hydrostatically pressure tested to 20,000 psi. No failure or damage was observed. The gun was then fired submerged in water under a hydrostatic pressure of 4,500 psi.

After firing, the outside diameter of the steel tube was measured, and the final expanded outer diameter of tubing in the vicinity of the charges, including the burr areas, did not expand beyond the original outer dimension of the tubing.

EXAMPLE 2

In another experiment performed to demonstrate the present invention, a well perforating device having the following specifications was used. The steel tubing was 1.625 inch inner diameter by 2,000 inch outer diameter. The outer profile of the steel tubing was reduced on its outside diameter by the amount of 0.125 inch around the explosive charges. The steel had a yield strength of 180,000 psi with an impact strength of 45–55 ft-lbs (Izod). The explosive charge was 2 ⅛" D.P. charge, Part No. 5202–1210 manufactured by Shape Charge Specialists, Inc. of Mansfield, Texas. The explosive load was 6.5 grams RDX.

Again, the perforating gun assembly was hydrostatically tested to 20,000 psi, and no failure or damage was observed. The gun was fired submerged in water under hydrostatic pressure of 2,500 psi.

After firing, the outside diameter of the tubing was measured and it was verified that the outer diameter, including the burr areas, was not expanded beyond the original diameter of 2.000 inches.

The above examples illustrate, and actual field conditions have proved, that the present invention provides a well perforating device that is able to function reliably under high hydrostatic pressures while remaining easily retrievable following the detonation of perforating explosive charges mounted therein for the purpose of perforating surrounding tubular goods. Further, the peripheral reduction of the outer diameter of the well perforating device had no detrimental effect upon the capability of the device to withstand the high hydrostatic pressures of very deep oil and gas wells.

It will be clear that the present invention is well adapted to carry out the objects and attain the advantages mentioned as well as those inherent therein. While a presently preferred embodiment of the invention has been described for the purposes of this disclosure, numerous changes can be made which will readily suggest themselves to those skilled in the art and which are encompassed within the spirit of the invention disclosed and as defined in the appended claims.

What is claimed is:

1. In a well perforating device comprising a body member having a plurality of hole penetration areas of reduced thickness formed in an outer surface thereof, and a plurality of hole guns positioned within the body member, each of the hole guns containing a hollow cone shaped explosive charge aligned with one of the hole penetration areas so that upon detonation of the hollow cone shaped explosive charge the body member is penetrated through the aligned hole penetration area, the improvement comprising:

a plurality of inwardly tapered wall expansion zones formed in the body member so as to circumferentially extend around the body member and encompass the hole penetration areas, each of the wall expansion zones having a wall thickness greater than the hole penetration area such that upon detonation of the hollow cone shaped charges of the hole gun the wall expansion zones are expanded to substantially correspond to the outside diameter of the body member.

2. The well perforating device of claim 1 wherein the body member is constructed of a material with yield strength sufficient to withstand the hydrostatic pressure of a petroleum well and having sufficient impact resistance so that the explosive energy of the shaped explosive charges upon detonation creates penetration holes with minimal extending burr areas.

3. The improvement of claim 1 wherein the body member comprises a cylindrical pressure vessel dimensioned to fit within the inside of petroleum well tubular goods, and wherein the hole guns are electrically connected by detonator cord to a detonator.

4. The improvement of claim 3 wherein the body member is constructed of a material with yield strength sufficient to withstand the hydrostatic pressure of a petroleum well and having sufficient impact resistance so that the explosive energy produced by detonation of the hollow cone shaped explosive charges creates penetration holes with minimal extending burr areas.

5. A well perforating device comprising:

a hollow cylindrical body member externally dimensioned to be receivable in the tubular goods of a petroleum well, the body member having at least one hole penetration area of reduced wall thickness;

explosive charge means disposed within the body member and alignable with the hole penetration area for penetrating the wall of the body member to form at least one penetration hole therethrough and for penetrating surrounding strata; and energy absorption means for controllably absorbing the energy of the explosive charge means so that excessive deformation of the external surface of the body member is prevented, the energy absorption means extending about the body member and encompassing the hole penetration area.

6. The well perforating device of claim 5 wherein the hollow cylindrical body member is characterized as having an outer surface, and wherein the energy absorption means comprises at least one inwardly tapered wall expansion zone circumferentially disposed in the outer surface of the body member and encompassing the focus point of the explosive charge means, each wall expansion zone defining an area of reduced wall thickness of the body member which is greater than the reduced wall thickness of the hole penetration area.

7. The well perforating device of claim 6 wherein the explosive charge means comprises a plurality of hollow cone shaped explosive charges electrically interconnected by a detonator cord to a detonator.

* * * * *